United States Patent [19]

Sensabaugh, Jr. et al.

[11] Patent Number: 4,545,392

[45] Date of Patent: Oct. 8, 1985

[54] TOBACCO PRODUCT

[75] Inventors: Andrew J. Sensabaugh, Jr.; Dewitt C. Crepps; William Y. Rice, Jr., all of Winston-Salem; George W. Fearrington, Jr., Pfafftown, all of N.C.

[73] Assignee: R. J. Reynolds Tobacco Co., Winston-Salem, N.C.

[21] Appl. No.: 516,995

[22] Filed: Jul. 25, 1983

[51] Int. Cl.[4] ..... A24B 15/18; A24B 15/28

[52] U.S. Cl. ..... 131/352; 131/310; 131/355

[58] Field of Search ..... 131/310, 352, 370, 355

[56] References Cited

U.S. PATENT DOCUMENTS

| | | | |
|---|---|---|---|
| 160,138 | 2/1875 | Appleby | 131/275 |
| 865,026 | 9/1907 | Ellis | 131/352 |
| 904,521 | 11/1908 | Ellis | 131/352 |
| 1,376,586 | 5/1921 | Schwartz | 131/366 |
| 3,166,078 | 1/1965 | Parmele et al. | 131/366 |
| 3,209,763 | 10/1965 | Parmele et al. | 131/140 |

FOREIGN PATENT DOCUMENTS

| | | |
|---|---|---|
| WO81/0209-08 | 8/1981 | PCT Int'l Appl. . |
| 0711187 | 6/1954 | United Kingdom . |

*Primary Examiner*—Vincent Millin

*Attorney, Agent, or Firm*—Herbert J. Bluhm

[57] ABSTRACT

A smokeless tobacco product is disclosed which contains cut or otherwise comminuted tobacco treated with a particulated gum composition that adheres as a discontinuous coating to the surface of the tobacco. The gum composition provides improved "gathering" characteristics and other benefits when the treated smokeless tobacco product is placed in the mouth of the consumer of such products.

27 Claims, No Drawings

TOBACCO PRODUCT

TECHNICAL FIELD

This invention relates to a novel smokeless tobacco product such as chewing tobacco or snuff and to a method for preparing same.

BACKGROUND ART

Snuff and chewing tobacco are frequently referred to as smokeless tobacco products because they are designed for use by the consumer without subjecting the product to a combustion process. Snuff and chewing tobacco products are manufactured in a variety of forms in order to appeal to different consumers. Chewing tobacco, for example, is produced as a firm plug, moist plug, twist, loose leaf and fine cut tobacco. Snuff is marketed in both dry and moist forms with the latter form being basically similar to the fine cut chewing tobacco.

At the present time loose leaf chewing tobacco is the most popular form of smokeless tobacco product while the fine cut/moist snuff category is the second most popular form. In spite of this wide popularity these product forms have a characteristic that is perceived as objectionable by consumers who continue to prefer plug chewing tobacco. The objectionable characteristic is the "float" associated with use of the product. In other words, the individual particles of tobacco tend to remain dispersed in the mouth of the consumer rather than to collect into a single aggregate that can be chewed like a portion of plug tobacco. Some consumers overcome the objectionable "float" characteristic by using chewing gum in conjunction with their use of smokeless tobacco products containing loose tobacco particles. Surprisingly, this practice has not yet led to the development of a satisfactory smokeless tobacco product which contains chewing gum as an integral part of the product. This failure to develop an acceptable chewing gum/smokeless tobacco combination is due to a variety of factors not the least of which is the consumer psychology involved. Thus, the fact that chewing gum is closely associated with candies and similar comestibles tends to detract from the masculine image portrayed by many smokeless tobacco products if they are offered in combination with chewing gum.

U.S. Pat. No. 865,026 discloses a masticable tobacco preparation designed to aid the user who wishes to discontinue the habit of chewing tobacco. This preparation comprises a relatively small proportion of tobacco coated completely by a wax or dispersed in a gum composition. A typical preparation taught in this patent contains 6 parts by weight of tobacco and 10 parts by weight of soft paraffin or gum chicle thoroughly mixed so that the tobacco particles are well protected by a film of the wax or gum. A similar preparation is described in U.S. Pat. No. 904,521 in which one part by weight of tobacco extract is mixed with two or more parts by weight of gum chicle.

U.S. Pat. No. 1,376,586 describes a product comprising chewing tobacco in the form of tablets or individual "chews" with the tablets being completely covered by gum chicle to give a coating that is impervious to both air and moisture.

British Patent Specification No. 711,187 discloses a chewing gum comprising 70 to 80 percent by weight gum base such as chicle, 10 to 20 percent by weight kola powder or similar filling material, 2 to 6 percent by weight powdered tobacco and up to 3 percent by weight other ingredients.

U.S. Pat. Nos. 3,166,078 and 3,209,763 involve a chewing tobacco product comprising more than 60 percent by weight of finely divided tobacco thermally bonded together by and dispersed in a matrix of water insoluble polymeric vinyl ester resin plasticized with triacetin, the matrix comprising from 20 to 40 percent by weight of the product. The product has chewable plasticity at human body temperature.

Swiss patent application No. 707/80 filed Jan. 29, 1980 and published Aug. 6, 1981 as PCT publication No. WO 81/02090 discloses a chewing tobacco product in the form of individual portions wherein the chewing tobacco is coated with a solid or semisolid carrier material or is distributed as small particles within the carrier material. One of the carrier materials disclosed is chewing gum and, according to the examples, the product contains 28.7 percent by weight of the gum base and 33.5 percent by weight tobacco. When chewing gum is used as the carrier material, it is apparently preferred that the tobacco be mixed with the gum to give a uniform distribution of tobacco particles within the carrier material.

In spite of the long history of attempts to develop a satisfactory smokeless tobacco product containing a chewing gum type of material, such attempts have not yet led to a product that has found acceptance among consumers of smokeless tobacco products.

BRIEF SUMMARY OF THE INVENTION

This invention provides an improved form of smokeless tobacco product having incorporated therein a gum composition.

It is a principal object of this invention to provide a method for preparing a smokeless tobacco product which reduces or eliminates the "float" characteristic associated with conventional smokeless tobacco products containing loose particles of tobacco.

It is a further object of this invention to provide a method for preparing a smokeless tobacco product having incorporated therein a gum composition in amounts and physical forms not readily discernable by the human eye.

It is another object of the present invention to provide a smokeless tobacco product having a reduced perception of stem content as well as improved body and texture integrity with an extended period of satisfaction to the consumer for each portion used.

It is yet a further object of the present invention to provide a tobacco composition which facilitates the manufacture of smokeless tobacco products therefrom.

These and other objects and advantages of the invention will be apparent from the detailed description which follows.

DETAILED DESCRIPTION OF THE INVENTION

Certain types of smokeless tobacco products are manufactured from fine particles or strips of tobacco which are subjected to various processing steps and treated with a number of additives. The two principal categories employing such processed tobacco are loose leaf chewing tobacco (sometimes referred to as "scrap") and moist snuff (which includes chewing tobaccos previously referred to as "fine-cut" tobacco). Both categories share a common consumer complaint relating to the tendency for individual particles of tobacco to "float" in the mouth of the consumer. Although it is generally appreciated that the simultaneous use of chewing gum and loose leaf chewing tobacco or moist snuff will result in a composite aggregate of chewing gum and tobacco in the mouth of the consumer, an acceptable smokeless tobacco product containing chewing gum has not heretofore been developed.

The present invention is based on the surprising discovery that gum compositions can be compounded and incorporated into smokeless tobacco products in such amounts and physical forms that their presence is not readily discernable by visual inspection but the amounts are, nevertheless, effective in greatly reducing or eliminating the objectionable "float" associated with the products. Equally surprising is the discovery that addition of low levels of gum compositions to such products significantly reduces the perception of tobacco stem material normally present in the products. The gum compositions also enhance the perception of product moistness and freshness. Use of the gum compositions also improves the efficiency of manufacturing processes used for making plug type chewing tobacco products. The added gum compositions may also be used as carriers for flavorants, if desired, thereby providing an additional advantage for their use.

Gum compositions which may be used for the purposes of this invention comprise water-insoluble natural and/or synthetic gum bases blended with one or more saccharides and/or sugar alcohols. The weight proportions of gum base to saccharide/sugar alcohol generally range between 1:1 and 1:5, respectively. The gum base is defined as the non-saccharide, water-insoluble, masticable component of the gum composition and is formulated from natural plant gums and/or synthetic materials including antioxidants, coloring agents and other modifiers incorporated into the gum base to control the masticatory and physical characteristics of the gum base.

Examples of natural gums which may be used in forming the gum base include those derived from plants belonging to the family Sapotaceae such as Chicle, Chiquibul, Crown gum, Gutta hang kang, Massaranduba balata, Massaranduba chocolate, Nispero, Rosidinka and Venezuelan chicle; the family Apocynaceae such as Jelutong, Leche caspi, Pendare and Perillo; the family Moraceae such as Leche de vaca, Niger gutta and tunu; and the family Euphorbiaceae such as Chilte and natural rubber. Suitable synthetic materials which may be used in forming the gum base include butadiene-styrene and isobutylene-isoprene copolymers, paraffins, petroleum wax, polyethylene, polyisobutylene, polyvinylacetate, glycerol ester of partially dimerized or polymerized rosin, glycerol ester of tall oil rosin and the glycerol or pentaerythritol esters of gum or wood rosin or partially hydrogenated gum or wood rosin. Generally, combinations of two or more of the above-named natural and synthetic materials are used in formulating gum bases designed to provide the particular chewing characteristics desired. A large number of gum bases are commercially available and they are generally formulated for use in either a standard chewing gum or a bubble gum product. Although many of these commercially available gum bases may be used in connection with the present invention, it is preferred that bubble gum bases be used because they provide chewing and adhesive characteristics that are ideally suited to smokeless tobacco products such as loose leaf chewing tobacco, plug chewing tobacco and moist snuff.

The gum compositions used in connection with this invention are prepared by procedures commonly used in the chewing gum industry. After the gum base has been prepared or obtained from a commercial source, it is softened or melted by heating it to temperatures of 50° to 100° C. and the desired amount of saccharide and/or sugar alcohol is blended with the gum base using a conventional mixer equipped with Sigma-type blades. Saccharides which may be used include, for example, monosaccharides such as glucose, fructose, galactose, mannose, arabinose and sorbose; disaccharides such as sucrose, lactose, maltose and cellobiose; and polysaccharides such as starch and maltodextrins. Suitable sugar alcohols which may be used include sorbitol, mannitol and galactitol. Mixtures of these materials as well as commercially available forms such as corn syrup and invert sugar may also be employed. In accordance with conventional processes for manufacturing chewing gum, it is preferred that the major portion of the saccharide and/or sugar alcohol added to the gum base be in the form of a dry, finely divided powder and that it be added gradually or incrementally during the mixing step. The maximum particle size of the powdered saccharide or sugar alcohol is such that individual particles will pass through sieve openings measuring 0.75 millimeter and preferably 0.50 millimeter.

The quantities of saccharides and/or sugar alcohols added to the gum base will be determined primarily by the composition of the gum base and the moisture content of the components being blended. The selection of the particular saccharide or sugar alcohol will depend largely on the degree of sweetness desired in the final product. In any case, the quantities of dry, solid saccharides and/or sugar alcohols added to the gum base should be sufficient to produce a doughlike consistency in the final product at temperatures of 45° to 55° C. and a relatively hard, brittle consistency at 20° to 25° C. The maltodextrins are especially useful components in the presently disclosed gum compositions because they provide a convenient means for reducing sweetness in the final product while contributing to improved texture and consistency characteristics in the final compositions. It is, of course, possible to substitute synthetic sweeteners for naturally sweet saccharides in the preparation of these gum compositions.

In addition to the basic ingredients discussed above, the gum compositions described herein may include certain optional ingredients. For example, humectants such as glycerol and propylene glycol may be included in the formulation at levels of approximately 3 percent or less based on the total weight of the combined ingredients. Water-soluble gums such as gum arabic, tragacanth or locust bean gum added in amounts of 2 percent or less of the total composition weight have a stabilizing influence on the physical characteristics of the gum compositions. Various flavoring materials such as fruit or tobacco flavors may also be incorporated into the gum compositions with use levels of one percent or less based on the total weight of the composition being generally sufficient.

A coloring agent may optionally be included in the formulation of the gum composition. Since the gum compositions are applied to the surface of tobacco particles in a manner hereinafter described, it is desirable that the coloring agent used be a brown color which approximates the color of the tobacco particles. Coloring agents constituting from 0.2 to 2.0 percent by weight based on the total weight of the gum composition are usually adequate to impart the desired color to the gum. The use of colored gum compositions is not essential for the purposes of this invention because the levels and physical form of gum compositions used in the smokeless tobacco products of this invention are such that the gum compositions associated with the tobacco are not discernible to the unaided human eye.

After the gum compositions have been prepared with the desired ingredients, it is an essential feature of this invention that the compositions be converted into a form that can be applied to the tobacco in the desired proportions. It has been discovered that this can be conveniently effected by transforming the gum compositions into a particulate form in which the maximum dimensions of the particles are one millimeter or less. Preferably, the maximum dimensions of the particles should be in the range of 0.25 to 0.40 millimeter. The gum compositions can be reduced to particulate form through the use of a pulverizer such as the model No. 2DH Mikro-Pulverizer or the Micro ACM Pulverizer available from Pulverizing Machinery, 26 Chatham Road, Summit, N.J. 07901. This reduction to particulate form is preferably accomplished while maintaining the temperature of the gum compositions at about 35° C. or below. If necessary, the resulting gum particles may be subjected to a sieving operation to remove oversize particles or to obtain particles in the preferred size range for application to the tobacco product. After the gum compositions have been reduced to particulate form and sieved (if necessary), it is advisable to avoid storing the gum particles for extended periods of time because the particles tend to agglomerate. This tendency of the gum particles to agglomerate can be greatly minimized by applying thereto colloidal silicon dioxide at levels of about 1 to 2 percent by weight based on the weight of the gum composition. The colloidal silicon dioxide can be conveniently applied by metering it into the pulverizer along with the gum composition so that the silicon dioxide becomes adhered to the surface of the gum particles as they are formed by the pulverizer.

The manufacture of smokeless tobacco products generally involves blending the desired tobaccos in strip form, cutting or otherwise comminuting the strips to give tobacco pieces of a size appropriate for the product being manufactured, treating the loosely associated pieces of cut or otherwise comminuted tobacco with casing and flavoring materials and drying the treated tobacco, if necessary, to reduce the moisture level to a range that is appropriate for the final product. It is also common practice to employ aging periods for the tobacco following application thereto of the casing and flavoring materials. In adapting the present invention to the manufacture of such products, no substantial changes in the basic processing steps are required.

In a preferred embodiment of this invention the particulate forms of the gum compositions described herein are applied to the tobacco after the tobacco has been treated with the casing materials and dried to a moisture level of 16 to 70 percent depending on the smokeless tobacco product that is to be prepared from the tobacco. The particulate form of the gum composition may be added to the loosely associated pieces of cut or otherwise comminuted tobacco as a thin layer of the tobacco pieces moves by conveyor belt beneath a vibratory feeder or other suitable feeding device which meters the desired quantity of gum particles onto the moving layer of tobacco pieces. It is preferred that the gum-treated tobacco layer be subjected to agitation means sufficient to effect a substantially uniform distribution of gum-treated tobacco throughout the mass of loosely associated pieces of tobacco. It is not necessary that gum particles be applied to all surfaces of the tobacco pieces being treated so long as the quantity of gum composition in each representative portion of the final tobacco product is approximately the same. It is important that the moisture level of the tobacco at the time of application of the gum composition particles to the tobacco be at least 16 percent and, preferably, at least 30 percent in order to achieve good adherence of the gum particles to the tobacco.

Following treatment of the loosely associated pieces of tobacco with the gum particles, the treated tobacco is further processed by conventional procedures normally used for the particular smokeless tobacco product being produced. For example, further processing steps may include an aging period to allow equilibration of moisture and flavoring materials, a drying step to reduce moisture content to desired levels and the addition of top flavoring to the treated tobacco. If a drying step is to be used for reducing moisture content, it is preferred that temperatures above approximately 90° C. for the heating medium be avoided. Typically, drying temperatures of about 40° to 90° C. are satisfactory for reducing moisture levels in the treated tobacco. The moisture levels desired for the final product generally range between 22 and 28 percent for loose leaf chewing tobacco, between 15 and 26 percent for plug chewing tobacco and between 25 and 60 percent for moist snuff. If top flavoring is added to the treated tobacco, such addition is preferably effected in a suitable volatile solvent such as ethanol subsequent to any final drying step. The treated tobacco is packaged in accordance with existing techniques used in the art or, in the case of plug chewing tobacco, it is first compressed into firm or moist plugs of desired shape prior to being packaged.

The quantities of gum composition applied to the tobacco should be sufficient to cause the particles of tobacco to gather into a cohesive mass of tobacco particles in the mouth of the consumer. Quite unexpectedly, it has been found that relatively low levels of the gum composition are required to promote a cohesive effect and to minimize the "float" problem associated with smokeless tobacco products. Although there is no upper limit to the quantities of gum which can provide the desired cohesive effect, the preferred maximum quantities of the gum compositions applied in accordance with this invention are those levels which are somewhat below the levels which are readily perceived by a visual inspection of the tobacco product.

In expressing the use levels of the gum compositions incorporated into the smokeless tobacco products disclosed herein, it should be noted that the tobacco being treated normally carries substantial amounts of previously applied casing materials. Moreover, the gum compositions usually contain variable amounts of saccharides and/or sugar alcohols. Since the amounts of casing, saccharides and/or sugar alcohols as well as the moisture levels of the tobacco being treated may vary considerably, it is preferable to express the gum composition use levels on the basis of the gum base component of the gum composition and the dry weight of the tobacco being treated exclusive of the moisture and casing material weight. The gum base has been defined previously herein as the non-saccharide, water-insoluble, masticable component of the gum composition including any modifiers incorporated into the gum base to control the masticatory and physical characteristics of the gum base. The dry tobacco weight is defined as the weight of tobacco without casing materials applied thereto and excluding moisture removable by heating the tobacco for 15 minutes in an oven that is maintained at 124° C. Based on these definitions the preferred quantity of gum base component incorporated into the smokeless tobacco product in the form of a compounded gum composition may vary from 1 to approximately 35 parts by weight per 100 parts by weight (dry basis) of tobacco in the product. Most preferably, the quantity of gum base component contained in the smokeless tobacco product is between 1 and 15 parts by weight per 100 parts of the dry tobacco weight in the product. The preferred quantities of gum composition applied and the manner in which they are applied to the tobacco result in a discontinuous coating of the gum composition adhering to the surface of a substantial proportion of the tobacco pieces treated.

Plug chewing tobacco products require special mention here since they are not generally considered to have a "float" problem associated therewith. Thus, the principal benefit derived from the use of gum compositions in loose leaf chewing tobacco and snuff products is considerably reduced in the case of plug chewing tobacco products. On the other hand, the use of gum compositions in a plug chewing tobacco product does provide a noticeable improvement in maintaining the tobacco as a cohesive mass in the mouth of the consumer. Moreover, it has unexpectedly been found that the application of gum compositions to tobacco in accordance with this invention produces major benefits in the manufacture of plug chewing tobacco products. Plug chewing tobacco products are formed by compressing the cased and flavored tobacco into a predetermined shape. The degree to which the tobacco is compressed determines the nature of the product (i.e., firm plug or moist plug) and how well the predetermined shape is retained. The manufacture of conventional moist plugs is particularly difficult because the tobacco is lightly compressed and the shaped plugs have a marked tendency to disintegrate after the compressive forces have been removed. This requires frequent recycling of tobacco recovered from plugs that have failed to retain their predetermined shape thereby resulting in a loss in manufacturing efficiency. This problem is also observed in connection with the manufacture of firm plugs of chewing tobacco although the problem is not as severe as with the moist plugs. Thus, the principal benefit associated with the use of gum compositions in plug chewing tobacco products is a marked increase in plug manufacturing efficiency. The processing of tobacco for the manufacture of plug chewing tobacco products with gum compositions incorporated therein is carried out in a similar manner to that described above with the treated tobacco being dried to moisture levels of about 15 to 26 percent before being shaped into plugs by conventional methods.

For a more complete understanding of the present invention, reference will now be made to several examples which describe the preparation of typical gum compositions and the use of such compositions in the preparation of smokeless tobacco products.

EXAMPLE 1

A commercial gum base available from L. A. Dreyfus Co. of Edison, N.J. 08817, under the trade name LADCO Bubble Base was used in preparing a gum composition. Using a steam jacketed vessel provided with a Sigma blade mixer, 20 parts by weight of the gum base was softened by heating it to about 50° C. Heating was then discontinued and mixed into the gum base in portions over a 20-minute time period were 58.5 parts by weight powdered sugar and 20 parts by weight MALTRIN M500, the latter being a granular maltodextrin available from Grain Processing Corporation of Muscatine, Iowa 52761. During the addition of the sugar and MALTRIN M500, the temperature of the gum base remained at about 50° C. due to the frictional heat associated with the mixer and the blending operation. Immediately following addition of the saccharides to the gum base, one part by weight gum arabic and 0.5 part by weight of Brown Lake Blend No. 9098, a brown coloring agent available from Warner-Jenkinson of St. Louis, Mo. 63106, were added to the mixture and mixing was continued for about 5 minutes. The uniformly blended gum composition was then removed from the mixing apparatus and formed into flat loaves or slabs which became hard and brittle upon cooling to room temperature. The cooled gum composition was crushed into coarse particles and fed into the feed hopper of a Mikro ACM Pulverizer obtained from Pulverizing Machinery of Summit, N.J. 07901. Fed into the feed hopper of the pulverizer with the gum composition was colloidal silica equivalent to 2 percent by weight based on the weight of the gum composition. The pulverizer was adjusted to mill the gum composition to a particle size of approximately 0.25 to 0.40 millimeter diameter with the colloidal silica coating the milled particles of gum to prevent agglomeration of the milled particles of gum composition. The silica-coated gum particles were subsequently applied to a smokeless tobacco product as described in Example 2.

EXAMPLE 2

A commercial blend of tobaccos was subjected to a cutting operation designed to produce cut tobacco suitable for a loose leaf chewing tobacco product. The cut tobacco was then cased with a proprietary aqueous mixture of flavoring materials (including sweetening agents) to give a cut and cased tobacco containing approximately 50 percent moisture. The tobacco was then heated briefly to reduce its moisture content to about 35 percent before it was arranged on a moving conveyor belt as a thin layer of loosely associated pieces of cut tobacco. The finely divided particles of gum composition prepared according to Example 1 were then applied to the layer of tobacco by a vibratory feeder positioned above the moving conveyor belt. The rate of application of the gum composition was controlled to give a treated product containing approximately 2 parts by weight of the gum base component in the gum composition for each 100 parts by weight of dry tobacco. Immediately following application of the gum composition particles, the treated tobacco was allowed to tumble through a downwardly sloping rotating drum provided with means on the interior surface thereof for promoting further agitation of the tumbling tobacco and redistribution of at least a portion of the applied particles of gum composition. The treated tobacco was placed into storage containers each designed to hold approximately 375 kilograms of tobacco and held at about 23° C. for about 16 hours. The tobacco was then removed from the storage containers and arranged as a thin layer on a conveyor belt which moved the tobacco through a dryer wherein the tobacco was heated briefly at about 70° C. to reduce its moisture content to 25 percent. Subsequent processing of the tobacco was conventional and included the application of a top flavoring solution, temporary storage to allow equilibration of the top flavoring additives throughout the tobacco mass and packaging of the product in moisture proof containers. The solids content of the sweetening agents contained in the casing mixture constituted approximately 32 percent by weight of the final product. A visual inspection of the final product gave no indication of the presence of the gum composition on the surface of the tobacco pieces.

The product prepared in this example was evaluated in a comparison test with a control product that was identical to the test product except that the control product did not contain the finely divided particles of gum composition. Test panelists were asked to rate the two products with respect to a number of attributes including (1) overall flavor, (2) "lasting" characteristics, (3) appearance, (4) aroma, (5) cohesiveness, (6) overall satisfaction, (7) stem content and (8) fresh taste. For each of these attributes the consensus of the panelists was that the test product was superior to the control product.

EXAMPLE 3

The following gum composition was prepared using the general procedure described in Example 1:

| | |
|---|---|
| LADCO Bubble Base | 20.0 parts |
| Powdered Sugar | 78.9 parts |
| Brown Lake Blend No. 9098 | 0.5 part |
| Fruit Flavoring | 0.6 part |

In this example the fruit flavoring was added to the gum mixture near the end of the blending period. The prepared composition was milled as described in Example 1 and used at levels which gave approximately 1.5 parts by weight of bubble base per 100 parts by weight of dry tobacco in the preparation of a loose leaf chewing tobacco. The resulting product was deemed to possess very good "gathering" characteristics with a body and texture that was longer lasting than an identical product not treated with the gum composition.

EXAMPLE 4

Using the general procedure described in Example 1, a gum composition containing the following ingredients was prepared:

| | |
|---|---|
| GRANDE Bubble Base (L.A. Dreyfus Co.) | 30.0 parts |
| Powdered Sugar | 49.0 parts |
| MALTRIN M100 (Grain Processing Corp.) | 20.0 parts |
| Gum Arabic | 1.0 part |

The prepared gum composition was milled as described in Example 1 to give particle sizes ranging between approximately 0.25 and 0.40 millimeter diameter. The resulting particles of gum composition were applied to a cut and cased tobacco according to the procedure of Example 2 to give a treated tobacco having the gum base component of the gum composition constituting about 2 parts by weight for each 100 parts by weight of dry tobacco. The moisture content of the treated tobacco was reduced to 23 percent and the treated tobacco was subsequently processed by conventional techniques and formed into moist plugs (i.e., lightly prized plugs) of chewing tobacco. The percentage of formed moist plugs rejected due to partial disintegration of the formed plugs was found to be reduced by about one third when compared to a plug making operation involving similarly processed tobacco that did not contain a gum composition. The flavor and chewing characteristics of the gum-containing moist plugs were found to be very satisfactory.

EXAMPLE 5

Using the general procedure described in Example 1 a gum composition containing the following ingredients was prepared:

| | |
|---|---|
| NOVA Standard Gum Base (L. A. Dreyfus Co.) | 45.0 parts |
| 42 D.E. Corn Syrup, 43° Be' | 5.0 parts |
| Powdered Sugar | 45.35 parts |
| Saccharin (calcium salt) | .15 part |
| Glycerol | 0.5 part |
| Caramel Coloring | 3.0 parts |
| Flavoring Agent (Peach No. 610633 obtained from Polak's Frutal Works of Middletown, New York 10940) | 1.0 part |

The flavoring agent was added to the gum composition near the end of the blending period. The prepared gum composition was reduced to particulate form by mixing it with solid carbon dioxide ("dry ice") and pulverizing the solid mixture in a Waring blendor. The resulting powdered gum composition was sieved and the gum particles smaller than about 0.42 mm were applied to cased chewing tobacco at two different levels in accordance with the general procedure of Example 2. The final products were in the form of loose leaf chewing tobacco containing about 26 percent moisture with the proportion of gum base being 8.75 parts and 17.5 parts by weight, respectively, per 100 parts by weight of dry tobacco.

Each of the test products was evaluated by panelists who were regular users of chewing tobacco products. Both test products were very favorably received by the panel members who declared that the taste and "chew" of the test products were superior to those of conventional loose leaf chewing tobacco products. The test products were also adjudged by the panelists as possessing a longer lasting flavor and lower stem content than comparable commercial products. An additional observation was that the tobacco packed well and did not float in the user's mouth.

EXAMPLE 6

Using the general procedure described in Example 1, a gum composition containing the following ingredients was prepared:

| | |
|---|---|
| GRANDE Bubble Base (L.A. Dreyfus Co.) | 30.0 parts |
| Powdered Sugar | 48.0 parts |
| MALTRIN M100 (Grain Processing Corp.) | 20.0 parts |
| Gum Arabic | 1.0 part |
| Brown Lake Blend No. 9098 | 1.0 part |

The prepared gum composition was milled as described in Example 1 to give particle sizes ranging between approximately 0.25 and 0.40 millimeter diameter. The particles of gum composition were then used to prepare a moist snuff product as described below.

A blend of tobacco strips adjusted to about 17 percent moisture was comminuted to give a range of tobacco particle sizes commonly used in moist snuff products. The comminuted tobacco was processed in accordance with commonly used procedures for snuff manufacturing including the spray addition of a casing sauce to the comminuted tobacco. The cased tobacco, containing about 55 percent moisture, was then divided into portions and treated with different levels of the particles of gum composition described above while the tobacco was being agitated in an inclined rotating drum. One portion of the cased tobacco was treated with a sufficient quantity of the gum composition to give a final product containing approximately 4.4 parts by weight of the gum base component per 100 parts by weight of dry tobacco while a second portion was treated to give about 17.5 parts by weight of the gum base component per 100 parts by weight of dry tobacco. A third portion, not treated with the gum composition, served as a control product. A proprietary mixture of top flavoring was added to each of the three portions and they were allowed to bulk overnight. The products containing the gum compositions were then evaluated in a comparison test with the control product. The moisture levels of the final products ranged from about 46% to 54%. The product containing 4.4 parts of gum base per 100 parts of dry tobacco was adjudged to have superior "gathering" characteristics in the user's mouth when compared with the control and this difference was particularly apparent after the product had remained in the user's mouth for about 5 minutes. An evaluation of the product containing 17.5 parts of gum base per 100 parts of dry tobacco produced a similar conclusion. Although both of the products containing the gum composition were found to have "gathering" characteristics that were superior to the control product, the product containing the higher level of gum base did not produce a "gathering" effect that was proportionately greater than the product containing the lower level of gum base.

What is claimed is:

1. A smokeless tobacco product comprising pieces of cut or otherwise comminuted tobacco and a gum composition adhering as a discontinuous coating to the surface of a substantial proportion of said pieces of cut or otherwise comminuted tobacco and wherein the quantity of said gum composition present in said product is sufficient to provide between 1 and 35 parts by weight of a non-saccharide, water-insoluble gum base component per 100 parts by weight of dry tobacco contained in said product.

2. A product according to claim 1 which is in the form of a plug type chewing tobacco.

3. A product according to claim 1 which is in the form of a loose leaf chewing tobacco.

4. A product according to claim 1 which is in the form of moist snuff.

5. A product according to claim 1, 2, 3 or 4 wherein the quantity of said gum composition provides between 1 and 20 parts by weight of said gum base component per 100 parts by weight of dry tobacco and said gum composition includes a maltodextrin.

6. A smokeless tobacco product comprising pieces of comminuted and cased tobacco with a substantial proportion of said pieces of comminuted and cased tobacco having a discontinuous coating of a gum composition adhering to the surface of said pieces, said gum composition being further characterized as containing a non-saccharide, water-insoluble bubble gum base component and being present in quantities sufficient to provide between 1 and 35 parts by weight of said bubble gum base component per 100 parts by weight of dry tobacco in said smokeless tobacco product.

7. A product according to claim 6 wherein the moisture content of the product is between 20 and 35 percent by weight.

8. The product according to claim 7 which is in the form of a plug type chewing tobacco.

9. A product according to claim 7 wherein the smokeless tobacco product is loose leaf chewing tobacco.

10. A product according to claim 7 wherein the smokeless tobacco product is moist snuff.

11. A product according to claim 6 or 7 wherein the quantity of said gum composition provides between 1 and 20 parts by weight of said bubble gum base component per 100 parts by weight of dry tobacco and said gum composition includes a maltodextrin.

12. A product according to claim 6, 7, 8, 9 or 10 wherein the gum composition adhering to the surface of said pieces of comminuted and cased tobacco has associated therewith quantities of colloidal silicon dioxide equivalent to 2 percent by weight or less of said gum composition.

13. A process for preparing a smokeless tobacco product which comprises (a) providing a quantity of moist, loosely associated pieces of cut or otherwise comminuted tobacco having a moisture content between 16 and 70 percent by weight, and (b) applying to the surface of a substantial proportion of said pieces of cut or otherwise comminuted tobacco a gum composition in particulate form which contains a non-saccharide, water-insoluble gum base component blended with a saccharide or sugar alcohol, the quantity of said gum composition applied to said tobacco being sufficient to provide between 1 and 15 parts by weight of said gum base component per 100 parts by weight of dry tobacco.

14. A process according to claim 13 wherein the particulate form of the gum composition consists of particles having maximum dimensions of one millimeter or less.

15. A process according to claim 13 wherein the particulate form of the gum composition applied to the tobacco has associated therewith quantities of colloidal silicon dioxide equivalent to 2 percent by weight or less of said gum composition.

16. A process according to claim 13 which includes the additional step of agitating the cut tobacco after the application thereto of the gum composition to effect a more uniform distribution of the gum composition on the surface of the cut tobacco.

17. A process according to claim 14 which includes the additional step of heating the tobacco at temperatures of 40° to 90° C. after the gum composition has been applied thereto to reduce the moisture content of said product to levels of 15 to 60 percent by weight.

18. A process according to claim 13, 14, 15, 16 or 17 wherein the initial moisture content of the cut or otherwise comminuted tobacco is between 30 and 70 percent by weight.

19. A process for treating tobacco in connection with the manufacture of a smokeless tobacco product therefrom comprising (a) establishing a moving, thin layer of moist, loosely associated pieces of cased and comminuted tobacco having a moisture content between 16 and 70 percent by weight, (b) applying to the moving, thin layer of tobacco controlled amounts of a gum composition in particulate form, said composition containing a non-saccharide, water-insoluble bubble gum base component and said controlled amounts being sufficient to provide between 1 and 35 parts by weight of said bubble gum base component for each 100 parts by weight (dry basis) of tobacco being treated, (c) subjecting the treated tobacco to agitation means sufficient to effect a substantially uniform distribution of treated tobacco throughout the mass of loosely associated pieces of cased and comminuted tobacco.

20. A process according to claim 19 wherein the particulate form of the gum composition consists predominantly of particles having maximum dimensions of one millimeter or less.

21. A process according to claim 20 wherein the particulate form of the gum composition applied to the tobacco has associated therewith quantities of colloidal silicon dioxide equivalent to 2 percent by weight or less of said gum composition.

22. A process according to claim 20 which includes the additional step of heating the treated tobacco at temperatures of 40° to 90° C. after said treated tobacco has been subjected to agitation means to reduce the moisture content of the treated tobacco to levels of 15 to 60 percent by weight.

23. A process according to claim 19, 20, 21 or 22 wherein the amounts of gum composition applied to the tobacco are sufficient to provide between 1 and 20 parts by weight of said bubble gum base component for each 100 parts by weight (dry basis) of tobacco being treated.

24. A process according to claim 23 wherein the final moisture of the treated tobacco is between approximately 15 and 26 percent by weight and said smokeless tobacco product is a plug type chewing tobacco.

25. A process according to claim 23 wherein the final moisture of the treated tobacco is between approximately 22 and 28 percent and said smokeless tobacco product is a loose leaf chewing tobacco.

26. A process according to claim 23 wherein the final moisture of the treated tobacco is between approximately 25 and 60 percent and said smokeless tobacco product is a moist snuff.

27. A process according to claim 23 wherein the initial moisture content of the cased and comminuted tobacco is between 30 and 70 percent by weight.

* * * * *